US009727010B2

(12) United States Patent
Tsubotani

(10) Patent No.: US 9,727,010 B2
(45) Date of Patent: Aug. 8, 2017

(54) IMAGE FORMING APPARATUS WITH FIXING DEVICE CONTROLLED BASED ON INTEGRATED ENERGY CONSUMPTION

(71) Applicant: KONICA MINOLTA, INC., Chiyoda-ku, Tokyo (JP)

(72) Inventor: Yoshikazu Tsubotani, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/212,328

(22) Filed: Jul. 18, 2016

(65) Prior Publication Data

US 2017/0023895 A1 Jan. 26, 2017

(30) Foreign Application Priority Data

Jul. 22, 2015 (JP) ..... 2015-144984

(51) Int. Cl.
*G03G 15/20* (2006.01)

(52) U.S. Cl.
CPC ..... *G03G 15/2039* (2013.01)

(58) Field of Classification Search
CPC combination set(s) only.
See application file for complete search history.

(56) References Cited

U.S. PATENT DOCUMENTS

2011/0064441 A1* 3/2011 Morihara ..... G03G 15/5004 399/69
2013/0084087 A1* 4/2013 Ikeda ..... G03G 15/2039 399/38

FOREIGN PATENT DOCUMENTS

JP 2008-249813 A 10/2008
JP 2012-016903 A 1/2012

* cited by examiner

*Primary Examiner* — Minh Phan
(74) *Attorney, Agent, or Firm* — Buchanan Ingersoll & Rooney PC

(57) ABSTRACT

An image forming apparatus configured to convey a recording material having an unfixed image on a surface includes a fixing device configured to fix the unfixed image on the recording material and a control device configured to perform image forming process control of the image forming apparatus, the fixing device including: a heating member heated by a heating device and a pressure member that binds the recording material on the surface of which the unfixed image is formed, and while letting the recording material pass between the pressure member oneself and the heating member, fixes the unfixed image onto the recording material, the control device calculating integrated energy consumption per unit time based on power consumption of the heating device and time needed for a print mode, and performing control of changing the image forming process.

13 Claims, 6 Drawing Sheets

FIG. 4

| OPERATION MODE | INTEGRATED ENERGY CONSUMPTION (Wh) PER UNIT TIME | ENERGIZATION RATIO PER UNIT TIME (%) |
|---|---|---|
| NORMAL MODE | 1500 | >40 |
| ENERGY-SAVING MODE 1 | 1200 | 30≤40 |
| ENERGY-SAVING MODE 2 | 1000 | <30 |

FIG. 5

| CORRECTION FACTOR | FIXING HEAT STORAGE STATE (°C) | RECORDING MATERIAL TEMPERATURE (°C) | RECORDING MATERIAL TYPE | |
|---|---|---|---|---|
| | | | SIZE | GRAMMAGE (g/m$^2$) |
| ×0.8 | >60 | >30 | >A4 | <52 |
| ×1.0 | 30≤60 | 23≤30 | A4 | 52≤60 |
| ×1.2 | <30 | <23 | <A4 | >60 |

FIG. 6

| ENERGIZATION RATIO PER UNIT TIME (%) | FIXING NIP WIDTH (mm) | TONER ADHESION AMOUNT ($g/m^2$) | IMAGE SCREEN RULING (lpi) | RECORDING MATERIAL CONVEYANCE SPEED (mm/s) | RECORDING MATERIAL OUTPUT INTERVAL (s) |
|---|---|---|---|---|---|
| > 40 | 9 | 8 | 160 | 240 | 4 |
| 30 ≤ 40 | 10 | 6 | 120 | 120 | 6 |
| < 30 | 11 | 4 | 80 | 60 | 8 |

IMAGE FORMING APPARATUS WITH FIXING DEVICE CONTROLLED BASED ON INTEGRATED ENERGY CONSUMPTION

The entire disclosure of Japanese Patent Application No. 2015-144984 filed on Jul. 22, 2015 including description, claims, drawings, and abstract are incorporated herein by reference in its entirety.

BACKGROUND OF THE INVENTION

Field of the Invention

The present invention relates to an image forming apparatus including a copier, a printer, and a FAX.

Description of the Related Art

In order to achieve low power consumption for environmental friendliness, it is necessary to suppress power consumption in a heating member of a fixing device that consumes relatively a large amount of power on an image forming apparatus. In recent years, measures for achieving a lower fixing temperature and a fixing member with lower heating capacity are increasingly implemented.

Patent Literatures that disclose techniques to suppress power consumption of the image forming apparatus include, for example, JP 2008-249813 A and JP 2012-016903 A.

On an image forming apparatus, energy consumption needed to increase the temperature of a heating member to a target temperature changes depending upon factors that vary over time, such as a heat storage state of a fixing device and a temperature of a recording material, and factors related to a heating value, such as thickness of the recording material.

Therefore, it is necessary, on each of print modes, to maintain a level of the energy consumption desired by a user, or below, while maintaining a predetermined range of fixability in each of print modes. To achieve this, it is necessary to perform control so as not to exceed prescribed integrated energy consumption per unit time, while considering the heat storage state of the fixing device, thickness of the recording material, a temperature of the recording material, or the like.

JP 2008-249813 A discloses control of instantaneous power consumption to a predetermined upper limit or below. However, control of energy consumption during execution for each of modes to a predetermined upper limit or below is not disclosed.

Specifically, in JP 2008-249813 A, a temperature of a fixing roller is controlled based on power consumption conditions, namely, conditions on power that can be consumed at image forming, and based on a result of detection by a temperature detection element. More specifically, when assuming power consumption (W) in a control system to be W1% of the total, power consumption (W) in a drive system to be W2% of the total, and power consumption (W) in a fixing system to be W3%, the temperature of the fixing roller at image forming is controlled by allocating power consumption (W) in the fixing system from a sum of available power consumption (W) based on this W3, which is calculated by W3=100−(W1+W2). This technique, however, cannot control energy consumption (Wh), namely, power consumption (W)×operation time (h), because the operation time (h) changes depending on print mode conditions such as the number of printed sheets.

Meanwhile, JP 2012-016903 A discloses a technique related to energy consumption. JP 2012-016903 A discloses a technique of selecting an operation mode at printing such that the energy consumption does not exceed the upper limit set for a predetermined period (e.g. one month).

In this, however, the upper limit of energy consumption is not set for each of modes, and there is no technique disclosed related to controlling an energization ratio at fixing for individual modes so as not to exceed the set upper limit of energy consumption.

Specifically, in JP 2012-016903 A, energy consumption for executed individual modes is stored, and accumulated energy consumption is compared with the energy consumption for a predetermined period (e.g. one month). In a case a difference is small, an operation mode with smaller energy consumption is selected, and a next mode is then printed.

As described in paragraph 0018 of JP 2012-016903 A, power consumption differs depending on print conditions even in a same operation mode. It is, thus, not possible to change image forming process conditions for each of modes. Accordingly, it is difficult to achieve "maintaining the energy consumption level desired by a user, or below, while maintaining a predetermined range of fixability in each of print modes".

SUMMARY OF THE INVENTION

The present invention has been made in view of the above-described issue, and an object thereof is to provide an image forming apparatus in which a control device performs control that changes image forming processes to achieve maintaining an energy consumption level desired by a user, or below, while maintaining a predetermined range of fixability in each of print modes.

To achieve the abovementioned object, according to an aspect, an image forming apparatus configured to convey a recording material having an unfixed image on a surface, the image forming apparatus comprising a fixing device configured to fix the unfixed image on the recording material and a control device configured to perform image forming process control of the image forming apparatus, reflecting one aspect of the present invention comprises the fixing device configured to fix the unfixed image on the recording material, wherein the fixing device includes: a heating member heated by a heating device and a pressure member that, in combination with the heating member, binds the recording material on the surface of which an unfixed image is formed, and while letting the recording material pass between the pressure member oneself and the heating member, fixes the unfixed image onto the recording material, and wherein the control device calculates integrated energy consumption per unit time based on power consumption of the heating device and time (h) needed for a print mode toward the recording material, and performs control of changing the image forming process such that energy consumption of the overall image forming apparatus needed for the print mode does not exceed the integrated energy consumption.

According to another aspect, the control device preferably determines time needed to increase a temperature of the heating device to a level at which a first recording material can be fed to the fixing device from a point at which the print mode is received, among the time needed for the print mode, by a heat storage state of the fixing device.

According to another aspect, the control device preferably calculates the time needed for the print mode based on a conveyance speed, size in a conveyance direction, and a conveyance interval, of the recording material, and based on the time needed to increase the temperature of the heating device.

According to another aspect, the image forming apparatus preferably further comprises an operation unit configured to receive operation to preselect a plurality of energy-saving modes, the control device preferably performs control based on selection operation received by the operation unit, and the control device preferably performs control so as not to exceed the integrated energy consumption per unit time preset for each of energy-saving modes, corresponding to the types of energy-saving modes received by the operation unit, and not to exceed the energization ratio per unit time.

According to another aspect, the control device, in changing the image forming process, controls the energization ratio per unit time toward the heating device.

According to another aspect, in controlling the energization ratio per unit time toward the heating device, the control device preferably performs control so as to maintain a fixed state of the toner image on the recording material that is preset arbitrarily.

According to another aspect, in control ling the energization ratio per unit time toward the heating device, the control is preferably performed by changing a width, in a circumferential direction, of a nip portion formed by the heating member and the pressure member.

According to another aspect, in controlling the energization ratio per unit time toward the heating device, the control is preferably performed by increasing or decreasing an adhesion amount of the toner image that forms the unfixed image on the surface of the recording material.

According to another aspect, in controlling the energization ratio per unit time toward the heating device, the control is preferably performed by changing screen ruling of a toner image that forms an unfixed image on a surface of the recording material.

According to another aspect, in controlling the energization ratio per unit time toward the heating device, the control is preferably performed by changing a conveyance speed of the recording material that passes through a nip portion formed between the heating member and the pressure member.

According to another aspect, in controlling the energization ratio per unit time toward the heating device, the control is preferably performed by changing an output interval of the recording material.

According to another aspect, the image forming apparatus preferably further comprises a recording material temperature-humidity detection device, and the control device, in changing the image forming process, preferably performs the change based on information obtained from both the energization ratio per unit time toward the heating device and at least one of temperature and humidity detected by the recording material temperature-humidity detection device.

According to another aspect, the image forming apparatus preferably further comprises a recording material type recognition device, and the control device, in changing the image forming process, preferably performs the change based on information obtained from both the energization ratio per unit time toward the heating device and recording material type information obtained by the recording material type recognition device.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 4 is a diagram illustrating relationships (setting values) among an operation mode, integrated energy consumption per unit time, and an energization ratio per unit time, in an Example;

FIG. 5 is a diagram illustrating relationships (setting values) among a correction factor, a fixing heat storage state, and a recording material temperature, and a recording material type, in an Example;

FIG. 6 is a diagram illustrating an energization ratio per unit time, a fixing nip width, toner adhesion amount, image screen ruling, a recording material conveyance speed, and a recording material output interval, in an Example;

DESCRIPTION OF THE PREFERRED EMBODIMENTS

Figure 1:
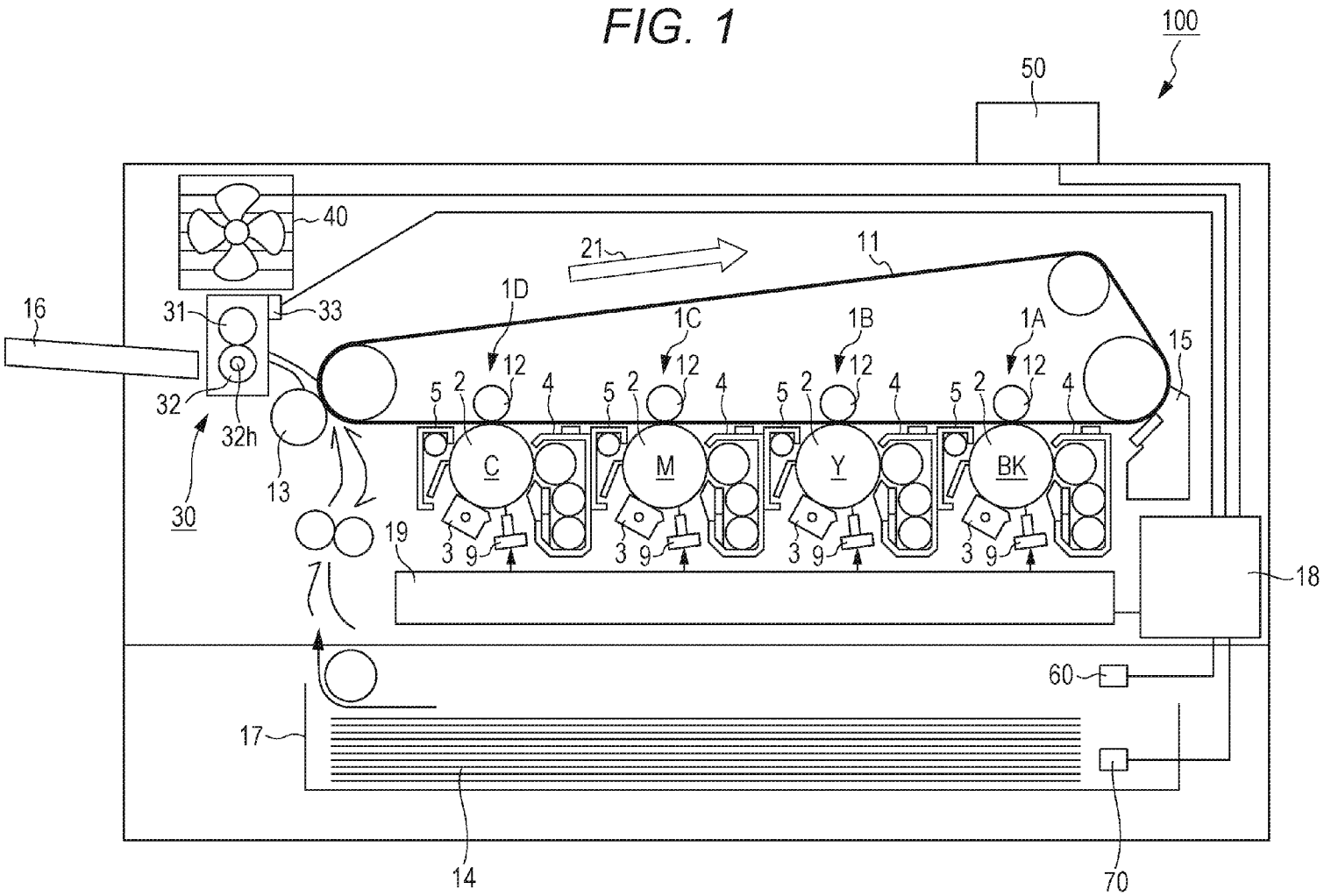
FIG. 1 is a diagram illustrating an internal configuration of an image forming apparatus according to an embodiment.

Hereinafter, an embodiment of an image forming apparatus according to the present invention will be described with reference to the drawings. However, the scope of the invention is not limited to the illustrated examples. In the embodiments described below, any reference to the number, amount, or the like, is not always intended to limit the scope of the present invention to such number, amount, or the like, unless otherwise specified. In some cases, same or equivalent components are denoted by a same reference numeral, and redundant description will not be repeated. It is originally intended that configurations of individual embodiments are appropriately combined to be used.

A typical recording material described below is a sheet (thin sheet, thick sheet, or the like). It is, however, not limited to the sheet, but represents all types of recording materials including a film, usable for an image forming apparatus 100.

(General Configuration of Image Forming Apparatus 100)

A general configuration of an image forming apparatus 100 according to the present embodiment will be described with reference to FIG. 1. FIG. 1 is a diagram illustrating an internal configuration of the image forming apparatus 100.

FIG. 1 illustrates the image forming apparatus 100 as a color printer. Hereinafter, the image forming apparatus 100 as a color printer will be described, although the image forming apparatus 100 is not limited to the color printer. For example, the image forming apparatus 100 may be a monochrome printer, or may be a multi-functional peripheral (MFP) incorporating a monochrome printer, a color printer, and a FAX.

The image forming apparatus 100 includes image forming units 1A to 1D, an intermediate transfer belt 11, a primary transfer roller 12, a secondary transfer roller 13, a cleaning unit 15, a sheet discharge tray 16, a cassette 17, a control device 18, an exposure control unit 19, a fixing device 30, and a fan 40.

The image forming unit 1A forms a toner image of black (BK). The image forming unit 1B forms a toner image of yellow (Y). The image forming unit 1C forms a toner image of magenta (M). The image forming unit 1D forms a toner image of cyan (C). The intermediate transfer belt 11 rotates in a direction of an arrow 21. The image forming units 1A to 1D are sequentially arranged along a rotating direction of the intermediate transfer belt 11.

Each of the image forming units 1A to 1D includes a photoreceptor 2, a charging unit 3, a developing unit 4, a cleaning unit 5, and an exposure unit 9. The photoreceptor 2 is an image bearing body that bears a toner image. An exemplary photoreceptor 2 is a photoreceptor drum having a photoreceptor layer formed on a surface thereof. The photoreceptor 2 rotates in a direction corresponding to the rotating direction of the intermediate transfer belt 11.

The charging unit 3 uniformly charges the surface of the photoreceptor 2. The exposure unit 9 emits a laser beam onto the photoreceptor 2 according to a control signal from the exposure control unit 19 and exposes the surface of the photoreceptor 2 according to a prescribed image pattern. With this procedure, an electrostatic latent image corresponding to an input image is formed on the photoreceptor 2.

The developing unit 4 develops the electrostatic latent image formed on the photoreceptor 2 as a toner image. For example, the developing unit 4 develops an electrostatic latent image by using a two-component developer including toner and carrier.

The toner image formed on the surface of the photoreceptor 2 is transferred to the intermediate transfer belt 11 by the primary transfer roller 12. At this time, toner images of black (BK), yellow (Y), magenta (M), and cyan (C) are sequentially superposed in order and transferred to the intermediate transfer belt 11. With this procedure, a colored toner image is formed on the intermediate transfer belt 11.

The cleaning unit 5 includes a cleaning blade. The cleaning blade is press-contacted against the photoreceptor 2 and collects the toner remaining on the photoreceptor 2 after transfer of the toner image.

The primary transfer roller 12 transfers the toner image developed on the photoreceptor 2 onto the intermediate transfer belt 11. The photoreceptor 2 and the intermediate transfer belt 11 are in contact with each other at a portion where the primary transfer roller 12 is disposed. A predetermined transfer bias is applied to this contact portion. With this transfer bias, the toner image on the photoreceptor 2 is transferred onto the intermediate transfer belt 11.

The cassette 17 is provided below the image forming apparatus 100. A recording material 14 such as a sheet is placed in the cassette 17. The recording material 14 is transferred from the cassette 17 to the secondary transfer roller 13 one sheet at a time. By synchronizing the timing of delivery and conveyance of the recording material 14 with a position of the toner image on the intermediate transfer belt 11, the toner image is transferred onto a suitable position on the recording material 14. Thereafter, the recording material 14 is transferred to the fixing device 30.

The fixing device 30 melts, by heat, the toner image transferred on the recording material 14 so as to fix the toner image onto the recording material 14. Thereafter, the recording material 14 is discharged to the sheet discharge tray 16. The fixing device 30 includes a heat roller 31 and a pressure roller 32. The heat roller 31 is a heating member heated by a heater 32*h*, namely, a heating device. The pressure roller 32 is a pressure member that, in combination with the heat roller 31, binds the recording material 14 on a surface of which an unfixed image is formed. The pressure roller 32, while letting the recording material 14 pass between itself and the heat roller 31, fixes the unfixed image onto the recording material 14.

The cleaning unit 15 includes a cleaning blade. The cleaning blade is press-contacted against the intermediate transfer belt 11 and collects the toner particles remaining on the intermediate transfer belt 11 after transfer of the toner image. The toner particles are conveyed by a conveyance screw (not illustrated) and collected into a waste toner container (not illustrated).

The control device 18 controls an image forming process of the image forming apparatus 100. The control device 18 controls the fixing device 30 (temperature control of the heater 32*h*, rotation speed of the heat roller 31, or the like), the exposure control unit 19, the fan 40, or the like. An instruction signal for various operation modes (energy-saving mode, etc.) from an operation unit 50 is input into the control device 18. In addition, information from a recording material temperature-humidity detection sensor 60 and a recording material type recognition sensor 70 are input into the control device 18. Control of the image forming process of the image forming apparatus 100 by the control device 18 will be described below in detail.

Figure 2:
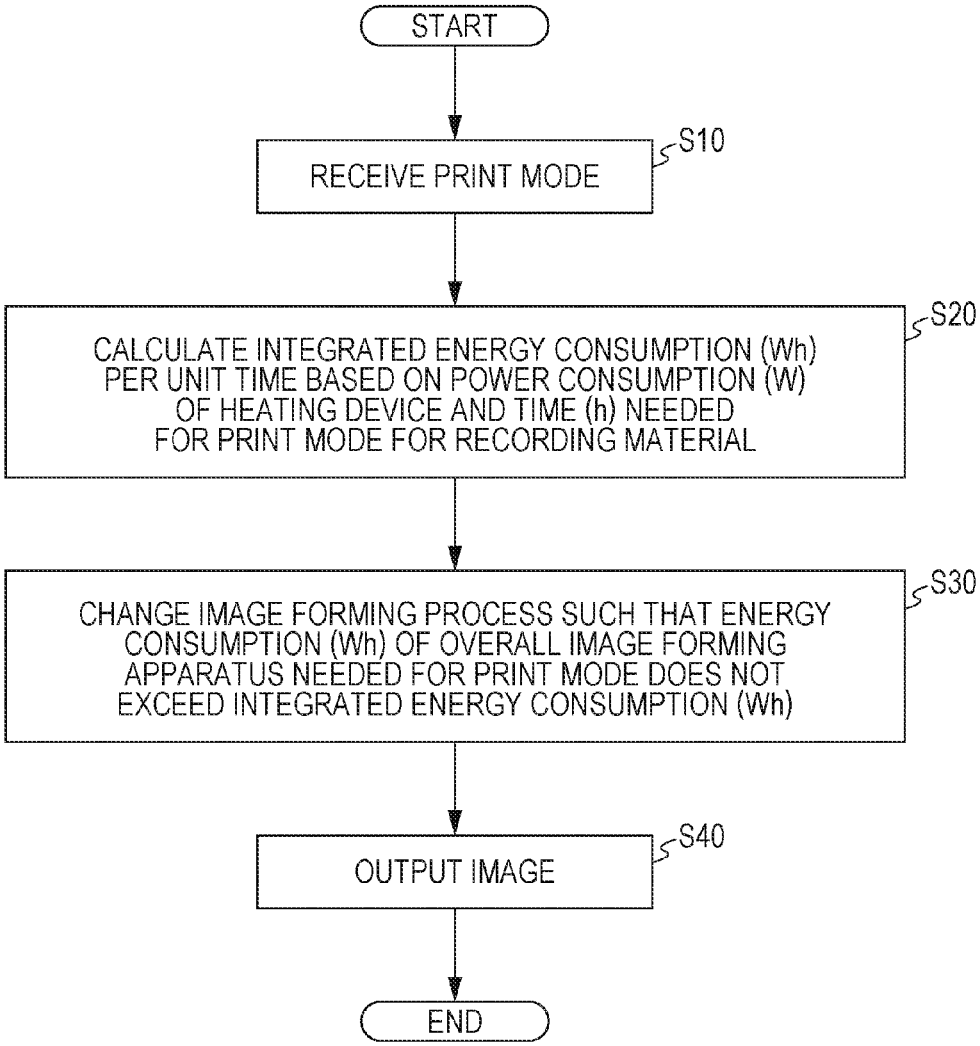
FIG. 2 is a diagram illustrating a fundamental control flowchart of an image forming apparatus according to an embodiment.

[Image Forming Process Control on Image Forming Apparatus 100] Image forming process control on the image forming apparatus 100 according to the present embodiment will be described with reference to FIG. 2. FIG. 2 is a flowchart illustrating image forming process control.

First, a fundamental flow in the image forming process control will be described with reference to FIG. 2. The control device 18 receives a print mode (S10). Next, integrated energy consumption (Wh) per unit time is calculated (S20) based on power consumption (W) of the heating device and time (h) needed for a print mode for the recording material 14.

Next, the control device 18 performs control of changing the image forming process (S30) such that energy consumption (Wh) of the overall image forming apparatus 100 needed for the print mode does not exceed the integrated energy consumption (Wh). Thereafter, the image forming process by the control device 18 is completed by outputting an image (S40).

The above-described control of changing the image forming process by the control device 18 ensures capability of controlling the image forming process while maintaining prescribed integrated energy consumption (Wh) per unit time, or below, by performing control based on integrated energy consumption (Wh) per unit time.

For example, as described below, by controlling an energization ratio per unit time toward the heat roller 31 on the fixing device 30, and by changing process conditions including a nip width on the fixing device 30, image density of an unfixed imaged on the recording material, an image pattern, a conveyance speed of the recording material, according to the energization ratio per unit time, or by changing process conditions including performing changes based on a heat storage state of the fixing device 30, ambient temperature and humidity, information on recording material, in fixing (heating) unfixed image on the recording material, it is possible to suppress energy consumption of the overall image forming apparatus 100 to be within a set range while maintaining optimum image quality.

Figure 3:
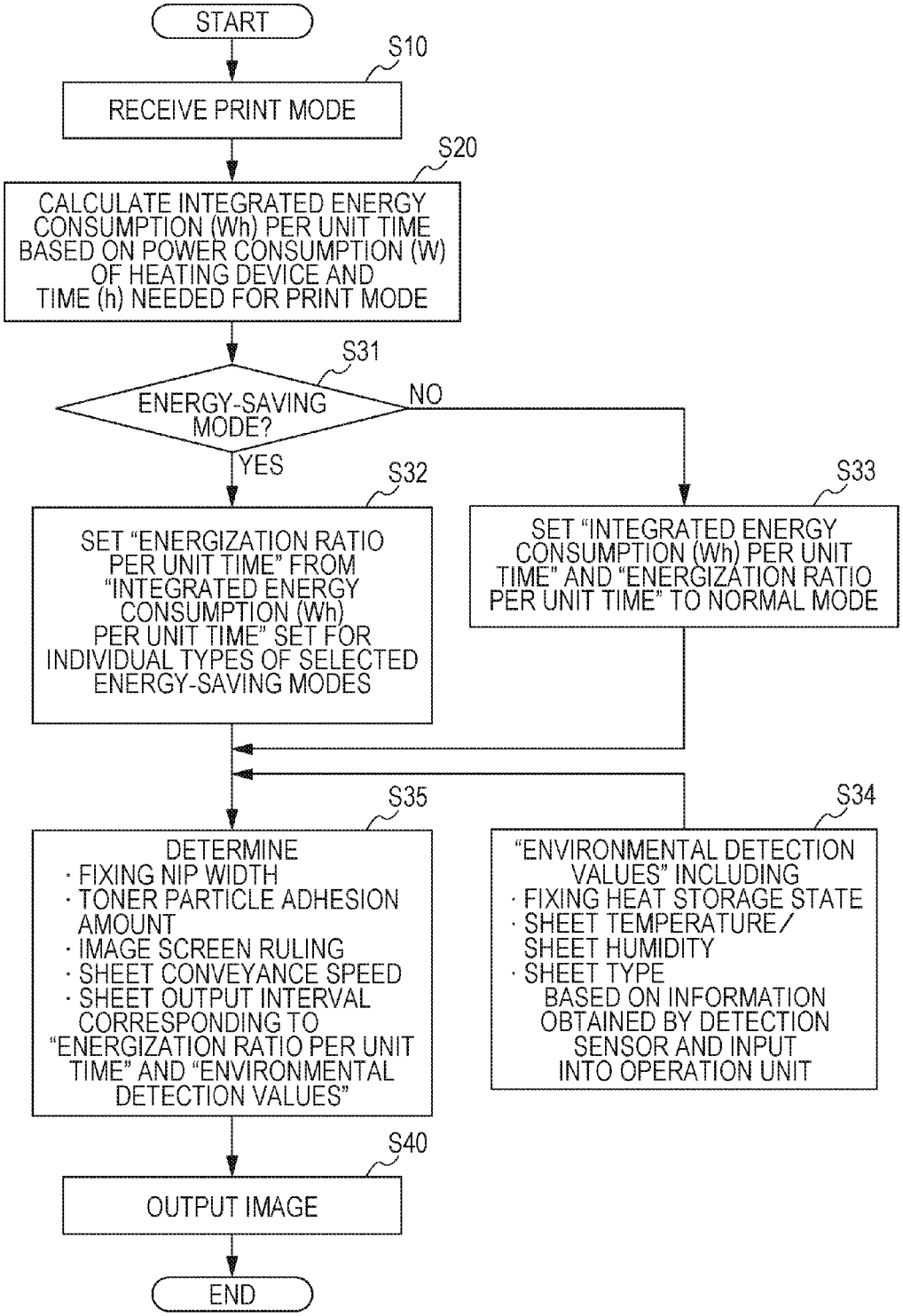
FIG. 3 is a diagram illustrating a control flowchart in an Example of an image forming apparatus according to an embodiment.

Next, a control flow of changing the image forming process based on the above-described embodiment, illustrated in an Example below, will be described with reference to FIG. 3. FIG. 3 is a diagram illustrating a control flow of changing the image forming process.

The control device 18 receives a print mode (S10). Next, integrated energy consumption (Wh) per unit time is calculated (S20) based on power consumption (W) of the heating device and time (h) needed for a print mode for the recording material 14.

Next, the control device 18 executes steps illustrated in S31 to S35 indicated below such that overall energy consumption (Wh) of the image forming apparatus 100 needed for the print mode does not exceed the integrated energy consumption (Wh).

First, determination is performed about whether "energy-saving mode" has been selected (S31). In a case where "energy-saving mode" has been selected, "energization ratio per unit time" is set from "integrated energy consumption (Wh) per unit time" set for each of types of energy-saving mode (S32).

Meanwhile, in a case where "energy-saving mode" has not been selected at S31, each of "integrated energy consumption per unit time (Wh)" and "energization ratio per unit time" is set to a normal mode (S33).

Based on information obtained by the recording material temperature-humidity detection sensor 60 and the recording material type recognition sensor 70, the control device 18 obtains "environmental detection values" including "fixing heat storage state", at least one of "recording material temperature" and "recording material humidity", and "recording material type" (S34).

Specifically, the control device 18 obtains, as "fixing heat storage state", temperature information of the fixing device 30 based on information from a temperature sensor 33 provided on the fixing device 30. Preferably, the control device 18 determines, by a heat storage state of the fixing device 30, time (h) needed to increase the temperature of the heater 32*h* to a level at which the first recording material 14 can be fed to the fixing device from a point at which the print mode is received, among the time (h) needed for the print mode. The reason is that, by considering the heat storage state, it would be possible to obtain appropriate information on energization time (h).

Based on information obtained from the recording material temperature-humidity detection sensor 60 as at least one of "recording material temperature" and "recording material humidity", the control device 18 obtains information on at least one of the recording material temperature and the recording material humidity. The control device 18 obtains information on recording material type based on information obtained from the recording material type recognition sensor 70.

Preferably, the control device 18 calculates the time (h) needed for the print mode based on a conveyance speed, size in a conveyance direction, and a conveyance interval, of the recording material 14, and based on the time (h) needed to increase the temperature of the heater 32*h* obtained above. By calculating the time (h) needed for the print mode, it is possible to estimate integrated energy consumption (Wh).

Next, parameters including "fixing nip width", "toner particle adhesion amount", "image screen ruling", "recording material conveyance speed", and "recording material output interval" corresponding to "energization ratio per unit time" and "environmental detection values" are determined as appropriate (S35). Thereafter, when an image has been output (S36), the image forming process by the control device 18 is completed.

To increase "fixing nip width" in controlling individual parameters means to move in a direction of increasing the fixing nip time, a pressurizing force, and fixability. To reduce the "fixing nip width" means the opposite of the above.

To reduce the "toner adhesion amount" means to move in a direction of increasing a heating value per mass given to a toner image, and increasing fixability. To increase the "toner adhesion amount" means the opposite of the above.

To reduce the "image screen ruling" means to move in a direction of reducing a toner adhesion amount on an edge portion due to an edge effect, and increasing the heating value per mass given to the toner image, and increasing fixability. To increase the "image screen ruling" means the opposite of the above.

To reduce the "recording material conveyance speed" means to move in a direction of increasing the time toner image passes the nip portion, increasing the heating value per mass given to the toner image, and increasing fixability. To increase the "recording material conveyance speed" means the opposite of the above.

To increase the "recording material output interval" means to move in a direction of increasing the nip temperature at a point where the second or later recording material comes in compared with a case in which the interval is shorter, increasing the heating value per mass given to the toner image, and increasing fixability. To reduce the "recording material output interval" means the opposite of the above.

Preferably, the control device 18 further includes the operation unit 50 that receives operation of preselecting a plurality of energy-saving modes, and performs control based on the operation received on the operation unit 50. Preferably, the control device 18 performs control so as not to exceed the integrated energy consumption per unit time preset for each of energy-saving modes, corresponding to the types of energy-saving modes received by the operation unit 50, and not to exceed the energization ratio per unit time. The reason is that, by performing selection on the operation unit 50, it would be possible to change the target integrated energy consumption (Wh) per unit time.

Preferably, in changing the image forming process, the control device 18 controls the energization ratio per unit time toward the heater 32*h*. The reason is that, by controlling the energization ratio per unit time toward the heater 32*h*, it would be possible to control the integrated energy consumption (Wh) per unit time.

Preferably, in controlling the energization ratio per unit time toward the heater 32*h*, the control device 18 performs control so as to maintain a fixed state of the toner image on the recording material 14 that has been preset arbitrarily. The reason is that, by changing the parameters, it would be possible to maintain the fixed state of the toner image on the recording material 14 that has been preset arbitrarily.

Preferably, in controlling the energization ratio per unit time toward the heater 32*h*, the control device 18 performs control by changing the width, in a circumferential direction, of a nip portion formed by the heat roller 31 and the pressure roller 32. The reason is that, by changing the nip width, it would be possible to change fixability of the unfixed image onto the recording material 14.

Preferably, in controlling the energization ratio per unit time toward the heater 32*h*, the control device 18 performs control by increasing or decreasing the adhesion amount of the toner image that forms an unfixed image on the surface of the recording material 14. The reason is that, by changing the adhesion amount, it would be possible to change fixability of the unfixed image onto the recording material 14.

Preferably, in controlling the energization ratio per unit time toward the heater 32*h*, the control device 18 performs control by changing the screen ruling of the toner image that forms an unfixed image on the surface of the recording material 14. By changing the screen ruling, it would be possible to change fixability of the unfixed image onto the recording material 14.

Preferably, in controlling the energization ratio per unit time toward the heater 32*h*, the control device 18 performs control by changing the conveyance speed of the recording material 14 that is fed through the nip portion formed between the heat roller 31 and the pressure roller 32, in a circumferential direction. The reason is that, by changing the conveyance speed of the recording material 14, it would be possible to change fixability of the unfixed image onto the recording material 14.

Preferably, in controlling the energization ratio per unit time toward the heater 32*h*, the control device 18 performs control by changing the output interval of the recording material 14. The reason is that, by changing the output interval, it would be possible to change fixability of the unfixed image onto the recording material 14 by changing the heat storage state.

Preferably, the image forming apparatus 100 further includes the recording material temperature-humidity detection sensor 60, and the control device 18 changes the image forming process based on information obtained from both the energization ratio per unit time toward the heater 32*h* and at least one of temperature and humidity detected by the recording material temperature-humidity detection sensor 60. The reason is that, by performing feedback of information of at least one of the recording material temperature and the recording material humidity to the control device 18, it would be possible to calculate optimum energization time.

Preferably, the image forming apparatus 100 further includes the recording material type recognition sensor 70, and the control device 18 changes the image forming process based on information obtained from both the energization ratio per unit time toward the heater 32*h* and the recording material type information obtained by the recording material type recognition sensor 70. The reason is that, by performing feedback of information of recording material type to the control device 18, it would be possible to calculate optimum energization time.

Example 1

Next, a control flow of changing an image forming process in specific Example 1 according to the flow illustrated in FIG. 3 will be described with reference to FIGS. 4 to 6. FIG. 4 is a diagram illustrating relationships (setting values) among the operation mode, the integrated energy consumption per unit time, and the energization ratio per unit time. FIG. 5 is a diagram illustrating relationships (setting values) among the correction factor, the fixing heat storage state, the recording material temperature, and the recording material type. FIG. 6 is a diagram illustrating the energization ratio per unit time, fixing nip width, toner adhesion amount, image screen ruling, recording material conveyance speed, and the recording material output interval.

In this image forming process control, a predetermined monochrome image is printed, as a print mode, on one surface of the recording material. The number of recording materials is 30.

Next, with reference to FIG. 4, when it is assumed that "energy-saving mode 1" is preselected on the operation unit 50, and then with reference to an integrated energy consumption (Wh) calculation table prepared for the received print mode, it is estimated that the integrated energy consumption (Wh) per unit time exceeds 1600 (Wh) under the control of the normal operation mode. In this case, determination is made such that control is performed with the energization ratio (%) per unit time of 30%≤40% to achieve the integrated energy consumption (Wh) per unit time of 1200 (Wh) in "energy-saving mode 1", or below, that has been preselected.

Next, with reference to FIG. 5, "environmental detection values" obtained by both the information obtained from the recording material temperature-humidity detection sensor 60 and the recording material type recognition sensor 70, and the input into the operation unit 50 specifically indicate such that the fixing heat storage state (° C.): "30≤60 (° C.)", recording material temperature (° C.): "23≤30", recording material size: A4, recording material grammage (g/m$^2$): "52≤60". Accordingly, the correction factor reflected to the parameter would be "×1.0".

Next, with reference to FIG. 6, since control is performed with the energization ratio (%) per unit time of 30%≤40%, and the correction factor is "×1.0" as determined as above, determination is made such that parameters of "fixing nip width", "toner particle adhesion amount", "image screen ruling", "recording material conveyance speed", and "recording material output interval" would be: "fixing nip width"=10 mm, "toner particle adhesion amount"=6 g/m$^2$, "image screen ruling"=120 lpi, "recording material conveyance speed"=120 mm/s, and "recording material output interval"=6 s.

By default conditions, according to the energization ratio (%) per unit time, the above-described parameters of "fixing nip width", "toner particle adhesion amount", "image screen ruling", "recording material conveyance speed", and "recording material output interval", would each obtain a corresponding value, reflected for each of all items. However, in cases where "image priority", "productivity priority" are preselected by the user, a change is made while setting "fixing nip width" being as a first priority item in each of the cases. When "image priority" is selected, a change is performed while prioritizing "recording material conveyance speed" and "recording material output interval", which have high contribution to productivity. When "productivity priority" is selected, change is made while prioritizing each of "toner adhesion amount" and "image screen ruling". Preferably, parameter values are selected even outside a range of parameter values specified by the energization ratio per unit time, and are ultimately output within a selected energization ratio per unit time.

Example 2

Next, a control flow of changing image forming process in specific Example 2 according to the flow illustrated in FIG. 3 will be described. In this image forming process control, a predetermined monochrome image is printed, as a print mode, on one surface of the recording material. The number of recording materials is 30.

In the present Example, the "energy-saving mode 1" is preselected. When an integrated energy consumption (Wh)

calculation table prepared for the received print mode is referenced, it is estimated that the integrated energy consumption (Wh) per unit time would exceed 1600 (Wh) under normal control. To cope with this, control is performed such that the integrated energy consumption (Wh) per unit time becomes "energy-saving mode 1" with 1200 (Wh) or below (refer to FIG. 4) that has been preselected. Specifically, image forming process conditions including the energization ratio per unit time toward a heating member, the nip width, the toner adhesion amount, the image screen ruling, the recording material conveyance speed, and recording material output interval are controlled such that parameters for these image forming process conditions corrected based on information including the heat storage state of the fixing device, the recording material type, and the recording material temperature, are combined to achieve the lowest integrated energy consumption (Wh) per unit time within an arbitrarily preset range in which the fixed state of the toner image onto the recording material is maintained.

Herein, the arbitrarily preset range in which the fixed state of the toner image onto the recording material is maintained represents a range in which a rank determined in at least one of a "rubbing test" and a "folding strength test" does not fall below an arbitrarily preset rank, and parameters are controlled within this range. The "rubbing test" is a test in which the image after fixation is rubbed so as to define a rank of the temperature difference between before and after rubbing. The "folding strength test" is a test in which the image after fixation is folded so as to define a rank of the temperature difference between before and after folding.

In the present Example, "energy-saving mode 1" with 1200 (Wh) or below is selected. Accordingly, the energization ratio (%) per unit time indicates 30≤40, and a column in which the energization ratio (%) per unit time indicates 30≤40 would be applied to each of the parameters as illustrated in FIG. 6. According to values of each of the detection sensors (information obtained by the recording material temperature-humidity detection sensor 60 and recording material type recognition sensor 70), the correction factor would be applied based on FIG. 5.

Example 3

Next, a control flow of changing image forming process in specific Example 3 according to the flow illustrated in FIG. 3 will be described. In this image forming process control, a predetermined monochrome image is printed, as a print mode, on one surface of the recording material. The number of recording materials is 30.

Also in the present Example, the "energy-saving mode 1" is preselected. When an integrated energy consumption (Wh) calculation table prepared for the received print mode is referenced, it is estimated that the integrated energy consumption (Wh) per unit time would exceed 1600 (Wh) under normal control. To cope with this, control is performed such that the integrated energy consumption (Wh) per unit time becomes "energy-saving mode 1" with 1200 (Wh) or below (refer to FIG. 4) that has been preselected. Specifically, combining with changing the image forming process conditions, image output mode is changed by using a means to change the number of output sheets such as double-sided printing and image aggregation, a means to reduce grammage of the recording material to be output, or the like.

Image output modes are preselected by the user. Specifically, when size priority is preselected, the double-sided printing is selected. When an output sheets reduction priority is preselected, the aggregate image printing is selected. When both of size and output sheets reduction are preselected, an image aggregation mode in combination with double-sided printing is selected. When automatic recording material thickness is selected, a sheet with the smallest recording material grammage is selected among the recording materials that are available on a sheet supply tray.

Other Examples

There are other methods as below beside the methods described above as methods for changing the image forming process conditions. Exemplary methods include a changing method of adjusting airflow using a fan attached to the image forming apparatus, a method of letting the recording material pass through the nip portion of the fixing device without allowing the unfixed image to be attached, or a method of preheating the recording material with heat in neighborhood, a method of performing preheating and heat retention by re-supplying warm air normally discharged as exhaust heat to the outside of the image forming apparatus, and a method of stopping a recording material in a state where there is the recording material at a nip portion in a process of fixing the unfixed image onto the fixing device.

Figure 7:
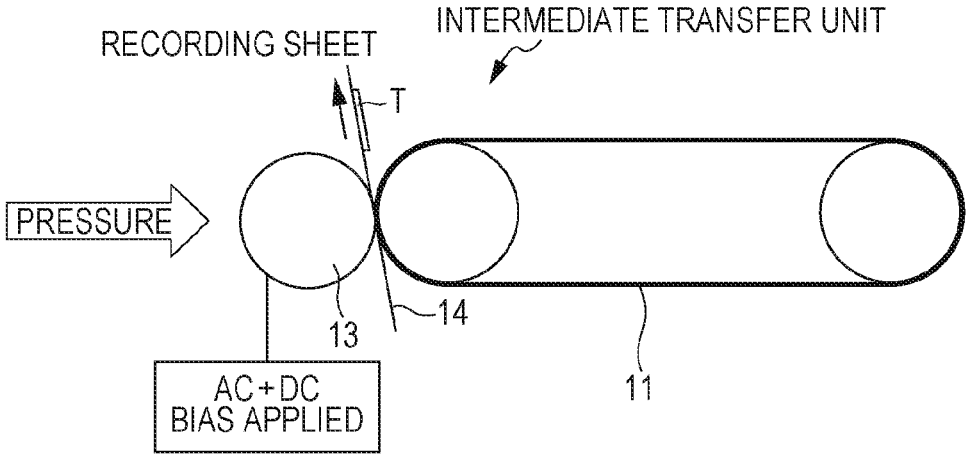
FIG. 7 is a schematic diagram illustrating increasing a physical adhesive force and an adhesion area of a toner image toward a recording material by increasing in AC voltage, DC voltage, and pressure, or the like, toward a secondary transfer roller, when an unfixed image is adhered onto the recording material, in an Example.
Figure 8:
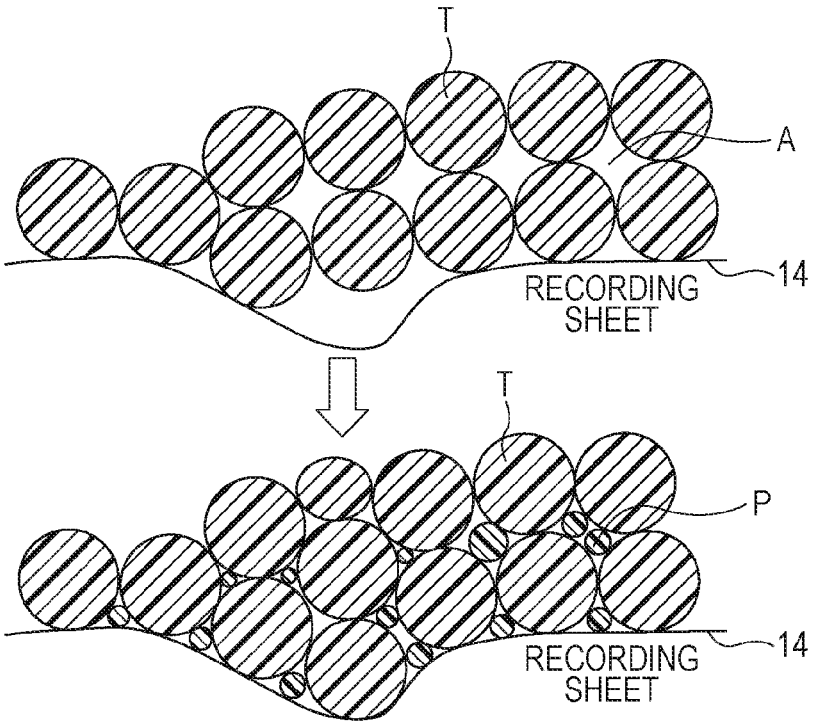
FIG. 8 is a schematic diagram illustrating an attempt to achieve reduction of spaces in toner images by increasing a ratio of fine toner particles, in an Example.

As illustrated in FIG. 7, there are still other methods of changing the image forming process conditions, including a method of reducing spaces or air layers in a toner image T by increasing a physical adhesive force and an adhesion areas of the toner images T to the recording material 14 by increasing AC voltage, DC voltage, and pressure, toward the secondary transfer roller 13 when the unfixed image is adhered to the recording material 14. Alternatively, in another method as illustrated in FIG. 8, it is allowable to attempt to achieve reduction of the spaces in the toner images T by increasing the ratio of fine toner particles P.

As described above, the image forming apparatus according to the present embodiments and Examples is capable of calculating energy consumption for overall image forming apparatus needed for received print mode based on energization ratio per unit time toward the heating member, and in a case where it is determined that the energy consumption exceeds prescribed integrated energy consumption per unit time, the image forming apparatus is capable of changing the image forming process conditions so as to achieve integrated energy consumption per unit time, or below.

For example, by controlling an energization ratio per unit time toward the heating member on the fixing device, and by changing process conditions, according to the energization ratio per unit time, including changing a nip width on the fixing device, image density of unfixed imaged on the recording material, image pattern, recording material conveyance speed, and productivity, based on a heat storage state of the fixing device, ambient temperature and humidity, information on recording material, it is possible to suppress energy consumption of the overall apparatus within a set range while maintaining optimum image quality.

Although the present invention has been described and illustrated in detail, it is clearly understood that the same is by way of illustrated and example only and is not to be taken by way of limitation, the scope of the present invention being interpreted by terms of the appended claims. The scope of the present invention is intended to include equivalents of the claims and all modifications within the scope.

What is claimed is:

1. An image forming apparatus configured to convey a recording material having an unfixed image on a surface, the image forming apparatus comprising a fixing device configured to fix the unfixed image on the recording material and a control device configured to perform image forming process control of the image forming apparatus, wherein the fixing device includes:

a heating member heated by a heating device; and a pressure member that, in combination with the heating member, binds the recording material on the surface of which the unfixed image is formed, and while letting the recording material pass between the pressure member oneself and the heating member, fixes the unfixed image onto the recording material, and wherein the control device calculates integrated energy consumption (Wh) per unit time based on power consumption (W) of the heating device and time (h) needed for a print mode toward the recording material, and performs control of changing the image forming process such that energy consumption (Wh) of the overall image forming apparatus needed for the print mode does not exceed the integrated energy consumption (Wh).

2. The image forming apparatus according to claim 1, wherein the control device determines time (h) needed to increase a temperature of the heating device to a level at which a first recording material can be fed to the fixing device from a point at which the print mode is received, among the time (h) needed for the print mode, by a heat storage state of the fixing device.

3. The image forming apparatus according to claim 2, wherein the control device calculates the time (h) needed for the print mode based on a conveyance speed, size in a conveyance direction, and a conveyance interval, of the recording material, and based on the time (h) needed to increase the temperature of the heating device.

4. The image forming apparatus according to claim 1, further comprising an operation unit configured to receive operation to preselect a plurality of energy-saving modes, wherein the control device performs control based on selection operation received by the operation unit, and the control device performs control so as not to exceed the integrated energy consumption per unit time preset for each of energy-saving modes, corresponding to the types of energy-saving modes received by the operation unit, and not to exceed an energization ratio per unit time.

5. The image forming apparatus according to claim 1, wherein the control device, in changing the image forming process, controls an energization ratio per unit time toward the heating device.

6. The image forming apparatus according to claim 5, wherein, in controlling the energization ratio per unit time toward the heating device, the control device performs control so as to maintain a fixed state of the toner image on the recording material that is preset arbitrarily.

7. The image forming apparatus according to claim 5, wherein, in controlling the energization ratio per unit time toward the heating device, the control is performed by changing a width, in a circumferential direction, of a nip portion formed by the heating member and the pressure member.

8. The image forming apparatus according to claim 5, wherein, in controlling the energization ratio per unit time toward the heating device, the control is performed by increasing or decreasing an adhesion amount of the toner image that forms the unfixed image on the surface of the recording material.

9. The image forming apparatus according to claim 5, wherein, in controlling the energization ratio per unit time toward the heating device, the control is performed by changing screen ruling of a toner image that forms an unfixed image on a surface of the recording material.

10. The image forming apparatus according to claim 5, wherein, in controlling the energization ratio per unit time toward the heating device, the control is performed by changing a conveyance speed of the recording material that passes through a nip portion formed between the heating member and the pressure member.

11. The image forming apparatus according to claim 5, wherein, in controlling the energization ratio per unit time toward the heating device, the control is performed by changing an output interval of the recording material.

12. The image forming apparatus according to claim 1, further comprising a recording material temperature-humidity detection device, wherein the control device, in changing the image forming process, performs the change based on information obtained from both an energization ratio per unit time toward the heating device and at least one of temperature and humidity detected by the recording material temperature-humidity detection device.

13. The image forming apparatus according to claim 1, further comprising a recording material type recognition device, wherein the control device, in changing the image forming process, performs the change based on information obtained from both an energization ratio per unit time toward the heating device and recording material type information obtained by the recording material type recognition device.

* * * * *